US010089797B1

(12) United States Patent
Begen et al.

(10) Patent No.: US 10,089,797 B1
(45) Date of Patent: Oct. 2, 2018

(54) SYSTEMS AND METHODS FOR PROVIDING LOCALIZED FUNCTIONALITY IN BROWSER BASED POSTAGE TRANSACTIONS

(75) Inventors: Geoffrey C. Begen, Lake Forest, CA (US); Michael John Biswas, Los Angeles, CA (US)

(73) Assignee: Stamps.com Inc., El Segundo, CA (US)

( * ) Notice: Subject to any disclaimer, the term of this patent is extended or adjusted under 35 U.S.C. 154(b) by 734 days.

(21) Appl. No.: 12/713,033

(22) Filed: Feb. 25, 2010

(51) Int. Cl.
*G07B 17/00* (2006.01)

(52) U.S. Cl.
CPC ..... *G07B 17/0008* (2013.01)

(58) Field of Classification Search
CPC ..... G07B 17/0008
See application file for complete search history.

(56) References Cited

U.S. PATENT DOCUMENTS

| | | | |
|---|---|---|---|
| 1,684,756 | A | 9/1928 | Close |
| 1,988,908 | A | 1/1935 | MacKinnon |
| 2,825,498 | A | 3/1958 | Alves |
| 2,887,326 | A | 5/1959 | Kramer |
| 3,221,980 | A | 12/1965 | Mecur |
| 3,380,648 | A | 4/1968 | De Lyra |
| 3,658,239 | A | 4/1972 | Foutz |
| 3,747,837 | A | 7/1973 | Wilson |
| 3,978,457 | A | 8/1976 | Check, Jr. et al. |
| 4,024,380 | A | 5/1977 | Gunn |
| 4,245,775 | A | 1/1981 | Conn |
| 4,253,158 | A | 2/1981 | McFiggans |
| 4,271,481 | A | 6/1981 | Check, Jr. et al. |
| 4,306,299 | A | 12/1981 | Check, Jr. et al. |
| 4,376,299 | A | 3/1983 | Rivest |
| 4,511,793 | A | 4/1985 | Racanelli |
| 4,565,317 | A | 1/1986 | Kranz |

(Continued)

FOREIGN PATENT DOCUMENTS

| | | |
|---|---|---|
| EP | 0137737 | 5/1991 |
| EP | 0 927 963 | 12/1997 |

(Continued)

OTHER PUBLICATIONS

Avery, Susan, "With new postage meters buyers can stamp out costs," Purchasing, 132, 11, Jul. 17, 2003, pp. 98-99.*

(Continued)

*Primary Examiner* — Nathan Erb
(74) *Attorney, Agent, or Firm* — Norton Rose Fulbright US LLP

(57) ABSTRACT

Systems and methods which implement localized functionality in a client server system using a technique of caching one or more functional objects for access in response to an appropriate server call are shown. Embodiments provide a browser based postage indicia generation and printing solution in which a browser upon which a postage client is operable is controlled to cache one or more functional objects in the form of script files. Various functional objects may be optimized for caching by clients such as postal rating scripts, postal insurance rating scripts, address verification scripts, etc. Security and/or accuracy verification may be implemented by a server to independently verify the results of the use of functional objects by a client.

25 Claims, 2 Drawing Sheets

(56) References Cited

U.S. PATENT DOCUMENTS 4,629,871 A 12/1986 Scribner et al.
4,641,347 A 2/1987 Clark et al.
4,649,266 A 3/1987 Eckert
4,661,001 A 4/1987 Takai et al.
4,709,850 A 12/1987 Wagner
4,725,718 A 2/1988 Sansone et al.
4,743,747 A 5/1988 Fougere et al.
4,757,537 A 7/1988 Edelmann et al.
4,760,532 A 7/1988 Sansone et al.
4,763,271 A 8/1988 Field
4,775,246 A 10/1988 Edelmann et al.
4,784,317 A 11/1988 Chen et al.
4,800,506 A 1/1989 Axelrod et al.
4,802,218 A 1/1989 Wright et al.
4,812,994 A 3/1989 Taylor et al.
4,821,195 A 4/1989 Baer et al.
4,831,554 A 5/1989 Storace et al.
4,831,555 A 5/1989 Sansone et al.
4,837,701 A 6/1989 Sansone et al.
4,853,865 A 8/1989 Sansone et al.
4,858,138 A 8/1989 Talmadge
4,862,386 A 8/1989 Axelrod et al.
4,864,618 A 9/1989 Wright et al.
4,868,757 A 9/1989 Gil
4,873,645 A 10/1989 Hunter et al.
4,900,903 A 2/1990 Wright et al.
4,900,904 A 2/1990 Wright et al.
4,900,941 A 2/1990 Barton et al.
4,901,241 A 2/1990 Schneck
4,908,770 A 3/1990 Breault et al.
4,910,686 A 3/1990 Chang et al.
4,919,325 A 4/1990 Culver
4,933,849 A 6/1990 Connell et al.
4,934,846 A 6/1990 Gilham
4,941,091 A 7/1990 Breault et al.
4,947,333 A 8/1990 Sansone et al.
4,993,752 A 2/1991 Juszak
4,998,204 A 3/1991 Sansone et al.
5,025,141 A 6/1991 Bolan
5,058,008 A 10/1991 Schumacher
5,065,000 A 11/1991 Pusic
5,079,714 A * 1/1992 Manduley et al. ..... 700/219
5,085,470 A 2/1992 Peach et al.
5,091,771 A 2/1992 Bolan et al.
5,111,030 A 5/1992 Brasington et al.
5,119,306 A 6/1992 Metelits et al.
5,136,647 A 8/1992 Haber et al.
5,150,407 A 9/1992 Chan
5,200,903 A 4/1993 Gilham et al.
5,202,834 A 4/1993 Gilham et al.
5,233,657 A 8/1993 Gunther et al.
5,237,506 A 8/1993 Horbal et al.
5,239,168 A 8/1993 Durst, Jr. et al.
5,280,531 A 1/1994 Hunter
5,289,540 A 2/1994 Jones
5,316,208 A 5/1994 Petkovsek
5,319,562 A 6/1994 Whitehouse
5,323,323 A 6/1994 Gilham et al.
5,323,465 A 6/1994 Avarne
5,341,505 A 8/1994 Whitehouse
5,375,172 A 12/1994 Chrosny
5,388,049 A 2/1995 Sansone et al.
5,423,573 A 6/1995 de Passille
5,437,441 A 8/1995 Tuhro et al.
5,439,721 A 8/1995 Pedroli et al.
5,454,038 A 9/1995 Cordery et al.
5,468,945 A 11/1995 Huggett et al.
5,471,925 A 12/1995 Heinrich et al.
5,476,420 A 12/1995 Manning
5,490,077 A 2/1996 Freytag
5,501,393 A 3/1996 Walz
5,510,992 A 4/1996 Kara
5,573,277 A 11/1996 Petkovsek
5,583,779 A 12/1996 Naclerio et al.
5,598,970 A 2/1997 Mudry et al.
5,600,562 A 2/1997 Guenther
5,602,743 A 2/1997 Fraytag
5,606,507 A 2/1997 Kara
5,606,508 A 2/1997 Thiel
5,606,613 A 2/1997 Lee et al.
5,615,123 A 3/1997 Davidson et al.
5,615,312 A 3/1997 Kohler
5,617,519 A 4/1997 Herbert
5,619,571 A 4/1997 Sandstrom et al.
5,623,546 A 4/1997 Hardy et al.
5,649,118 A 7/1997 Carlisle et al.
5,650,934 A 7/1997 Manduley
5,655,023 A 8/1997 Cordery et al.
5,666,284 A 9/1997 Kara
5,675,650 A 10/1997 Cordery et al.
5,696,829 A 12/1997 Cordery et al.
5,706,502 A 1/1998 Foley et al.
5,715,314 A 2/1998 Payne et al.
5,717,596 A 2/1998 Bernard et al.
5,717,597 A 2/1998 Kara
5,742,683 A 4/1998 Lee et al.
5,745,887 A 4/1998 Gargiulo et al.
5,774,554 A 6/1998 Gilham
5,774,886 A 6/1998 Kara
5,778,076 A 7/1998 Kara et al.
5,791,553 A 8/1998 Fabel
5,796,834 A 8/1998 Whitney et al.
5,799,290 A 8/1998 Dolan et al.
5,801,364 A 9/1998 Kara et al.
5,801,944 A 9/1998 Kara
5,805,810 A 9/1998 Maxwell
5,812,991 A 9/1998 Kara
5,819,240 A 10/1998 Kara
5,822,739 A 10/1998 Kara
5,825,893 A 10/1998 Kara
5,860,068 A 1/1999 Cook
5,884,277 A 3/1999 Khosla
5,902,439 A 5/1999 Pike et al.
5,923,406 A 7/1999 Brasington et al.
5,923,885 A 7/1999 Johnson et al.
5,929,415 A 7/1999 Berson
5,946,671 A 8/1999 Herring et al.
5,983,209 A 11/1999 Kara
6,005,945 A 12/1999 Whitehouse
6,010,156 A 1/2000 Block
6,026,385 A 2/2000 Harvey et al.
6,061,670 A 5/2000 Brand
6,098,057 A 8/2000 Dlugos
D434,438 S 11/2000 Kara
6,155,476 A 12/2000 Fabel
6,173,888 B1 1/2001 Fabel
6,202,057 B1 3/2001 Pierce
6,208,980 B1 3/2001 Kara
6,233,565 B1 * 5/2001 Lewis et al. ..... 705/35
6,442,525 B1 8/2002 Silverbrook et al.
6,470,327 B1 * 10/2002 Carroll et al. ..... 705/401
6,721,717 B2 4/2004 Kramer
6,820,065 B1 11/2004 Naclerio
6,865,561 B1 * 3/2005 Allport et al. ..... 705/406
7,433,849 B2 10/2008 Cordery et al.
7,774,284 B2 8/2010 Williams et al.
8,000,988 B1 8/2011 Bezanson et al.
8,078,293 B2 12/2011 Campagna et al.
8,150,781 B2 4/2012 McCall et al.
8,195,579 B2 6/2012 Kara
8,412,641 B2 4/2013 Zeisset et al.
8,630,912 B2 * 1/2014 Seki et al. ..... 705/26.1
2001/0007086 A1 7/2001 Rogers et al.
2001/0032278 A1 * 10/2001 Brown et al. ..... 710/101
2001/0037320 A1 11/2001 Allport et al.
2002/0032668 A1 3/2002 Kohler et al.
2002/0152127 A1 * 10/2002 Hamilton et al. ..... 705/26
2003/0004824 A1 1/2003 Joshi et al.
2003/0144972 A1 7/2003 Cordery et al.
2004/0083189 A1 4/2004 Leon
2004/0089711 A1 5/2004 Sandru
2004/0122779 A1 6/2004 Stickler et al.
2004/0133438 A1 7/2004 Zeisset et al.
2004/0243523 A1 * 12/2004 Herbert ..... 705/408

(56) References Cited

U.S. PATENT DOCUMENTS

| | | | | |
|---|---|---|---|---|
| 2004/0258089 | A1* | 12/2004 | Derechin et al. | 370/465 |
| 2005/0256811 | A1 | 11/2005 | Pagel et al. | |
| 2007/0011023 | A1 | 1/2007 | Silverbrook | |
| 2007/0174213 | A1* | 7/2007 | Whitehouse et al. | 705/401 |
| 2007/0233754 | A1 | 10/2007 | Baeuerle et al. | |
| 2008/0127139 | A1* | 5/2008 | Skaistis | G06F 8/427 717/143 |
| 2008/0178162 | A1* | 7/2008 | Sanford et al. | 717/139 |
| 2008/0228669 | A1* | 9/2008 | Harris et al. | 705/408 |
| 2008/0298568 | A1 | 12/2008 | Karandikar | |
| 2009/0144230 | A1* | 6/2009 | Fant | 707/2 |
| 2009/0241030 | A1* | 9/2009 | von Eicken et al. | 715/735 |
| 2009/0319395 | A1 | 12/2009 | Chandaria | |
| 2011/0071954 | A1 | 3/2011 | McCall et al. | |

FOREIGN PATENT DOCUMENTS

| | | | |
|---|---|---|---|
| EP | 926632 | A2 | 6/1999 |
| EP | 0 927 958 | | 7/1999 |
| FR | 2580844 | | 10/1986 |
| GB | 2251210 | | 7/1992 |
| JP | 05-132049 | | 5/1993 |
| JP | 09-508220 | | 8/1997 |
| JP | 02000105845 | | 4/2000 |
| JP | 04284558 | B2 | 6/2009 |
| WO | WO-88/01818 | A1 | 3/1988 |
| WO | WO-1995/19016 | | 7/1995 |
| WO | WO-98/14909 | | 4/1998 |
| WO | WO-9814907 | | 4/1998 |
| WO | WO-98/57302 | | 12/1998 |
| WO | WO-98/57460 | | 12/1998 |

OTHER PUBLICATIONS

Davis Brad L.; "Printing System for Preventing Injustice by Delivering Print Data from Postal Charge Meter to Printer," Jan. 2001, 1 page.

Office Action dated Mar. 13, 2007 for JP 515,253/97; with English language translation (4 pages).

Minnick, Robert, "Postage Imprinting Apparatus and Methods for Use With a Computer Printer", Apr. 27, 1995, 71 pgs.

Office Action issued for Japanese Patent Application No. 515,253/1997, dated Apr. 21, 2009; 5 pages (with English language translation).

"Service contracts: profit center or necessary evil. (heating and air conditioning maintenance contracts)", Whitaker, Bert, Air Conditioning, Heating & Refrigeration News, v192, n3, p22(2); 3 pages.

"Information-Based Indicia Program (IBIP): Performance Criteria for Information-Based Indicia and Security Architecture for Open IBI Postage Evidencing Systems," Feb. 23, 2000, The United States Postal Service (USPS), 79 pages.

Unpublished U.S. Appl. No. 10/606,579 to Ogg, filed Jun. 26, 2003 and entitled "System and Method for Automatically Processing Mail."

* cited by examiner

SYSTEMS AND METHODS FOR PROVIDING LOCALIZED FUNCTIONALITY IN BROWSER BASED POSTAGE TRANSACTIONS

CROSS-REFERENCE TO RELATED APPLICATIONS

The present application is related to co-pending, commonly assigned U.S. patent application Ser. No. 10/862,058 entitled "Virtual Security Device," filed Jun. 4, 2004, the disclosure of which is hereby incorporated herein by reference.

TECHNICAL FIELD

The present invention relates to conducting transactions for the generation of postage indicia and, more particularly, to providing localized functionality in browser based postage transactions.

BACKGROUND OF THE INVENTION

Computer based systems for generating and printing postage indicia have been available for a number of years, see for example U.S. Pat. No. 5,510,992 entitled "System and Method for Automatically Printing Postage on Mail" and U.S. Pat. No. 5,822,739 entitled "System and Method for Remote Postage Metering," assigned to Stamps.com, Inc. the assignee of the present application. Such computer based systems have largely replaced more traditional postage meters in many market segments because of the widespread availability of appropriate host systems, ease of use, etc. However, there remains room for advancement with respect to the operation and use of such computer based systems in performing postage transactions.

Client server computer based postage indicia generation and printing systems typically invoke a series of server calls from the client in order to generate and print postage indicia. For example, a postage client may operate to collect data about a postal item and desired postal service from a user and issue a postage server call, transmitting the collected postal item information to the postage server, to obtain a postal rate for the postal item. If the user wishes to change an aspect of the desired postal service (e.g., request first class rather than overnight) or alters an aspect of the postal item (e.g., size or weight), another postage server call, transmitting the revised postal item information to the postage server, is made to obtain a revised postal rate for the postal item. Thereafter, the postage client may issue additional postage server calls for completing postage indicia generation, such as a postage server call to have the addressee information validated, a postage server call to obtain an insurance rate, etc. Upon completing the postage indicia generation processing to the user's satisfaction, a postage server call may be made by the postage client to request generation of the postage indicia and transmission of the postage indicia to the postage client for printing.

Each of the foregoing postage server calls requires appreciable time to complete (e.g., up to seconds or longer). Nevertheless, the client server model typically implements such centralized functionality to facilitate the use of a relatively thin postage client, thereby facilitating its widespread distribution and operation, to avoid issues with maintaining software and database updates throughout the network, etc.

BRIEF SUMMARY OF THE INVENTION

The present invention is directed to systems and methods which implement localized functionality in a client server system using a technique of caching one or more functional objects for access in response to an appropriate server call. For example, embodiments of the invention provide a browser based postage indicia generation and printing solution in which a browser (upon which a postage client is operable) is controlled to cache one or more functional objects in the form of script files, such as may comprise postage rating scripts, postage insurance rate scripts, address validation scripts, etc. Such functional objects are preferably accessed by an appropriate postage server call, such as through the use of a corresponding uniform resource locator (URL) or other resource identifier, which is redirected to the cache by the browser. Accordingly, a client may be provided functionality associated with the functional object without experiencing the latency associated with communication to and from the corresponding server.

Embodiments of the invention operate to facilitate transparent management of the localized functional objects, to thereby provide appropriate updating of functional objects without requiring express user interaction or even knowledge of the updating. For example, when the data of any such functional object becomes out of date, or otherwise requires updating, the resource identifier for an updated functional object is provided to the client according to embodiments, and thus the previously cached functional object is no longer utilized by the client. Upon initially accessing the updated functional object, the updated functional object is preferably cached for subsequent use by the client.

Various functional objects may be optimized for caching by clients according to embodiments of the invention. For example, postal rating tables may be divided by zones (e.g., shipper location zones) and postage rating scripts created for each such zone. A postage client may thus access and cache a postage rating script for a zone appropriate to the user thereof, thereby avoiding transfer of the complete rating table information to the cache. Accordingly, in addition to avoiding latency associated with communication to and from a postage server for rating information during subsequent postage transactions, embodiments operate to minimize latency associated with initially caching the functional objects.

Embodiments of the invention implement security and/or accuracy verification with respect to the use of localized functionality herein. For example, functional objects provided for use by clients may be subject to malicious or inadvertent alteration, or otherwise be improperly used. Accordingly, embodiments of the invention implement verification by a server of the results of use of the use of functional objects by a client prior to completing a transaction. For example, a postage server may operate to independently verify the rate calculation for a postage indicium requested to be generated by a postage client having implemented a postage rating script. Such verification may be done in conjunction with another server call to facilitate efficiencies with respect to client server communications provided through the use of localized functional objects of embodiments of the invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
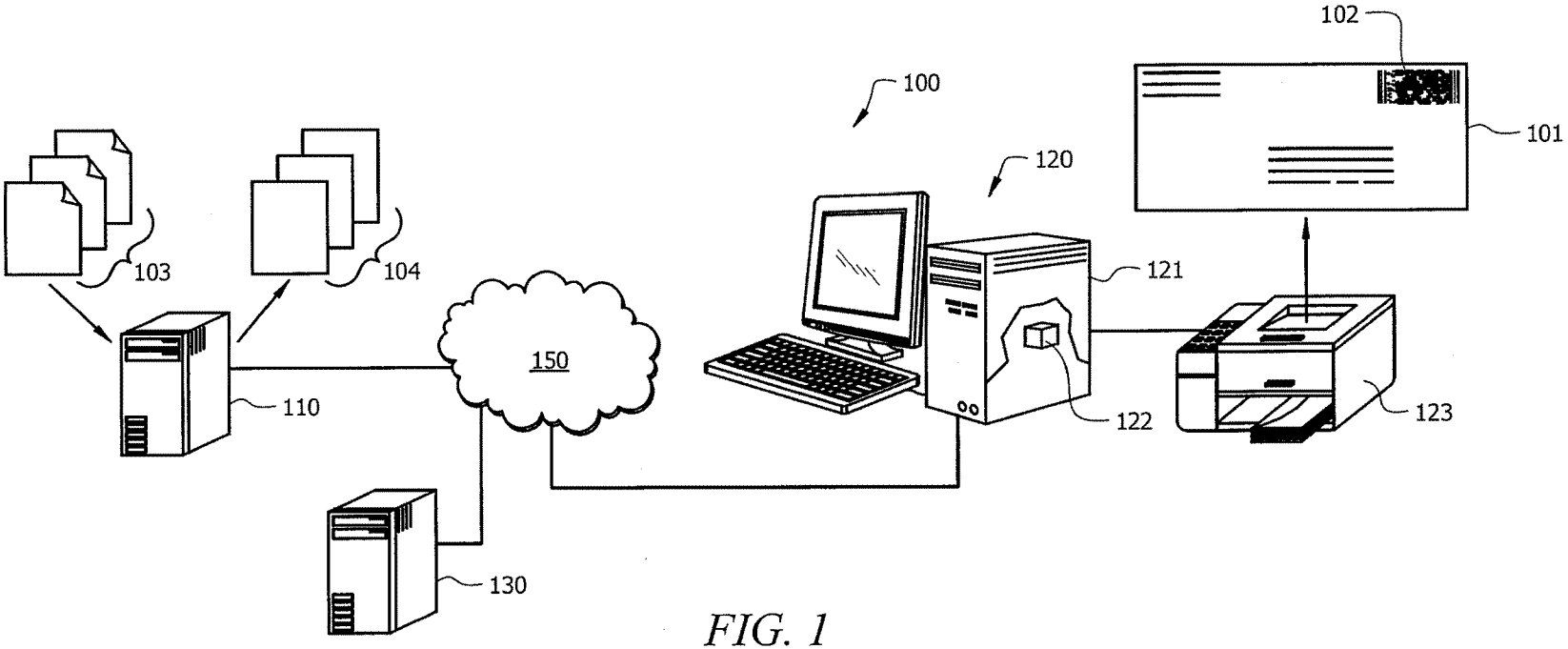
FIG. 1 shows a system adapted according to embodiments of the invention.

FIG. 1 shows system 100 adapted according to embodiments of the invention to implement localized functionality in a client server system using a technique of caching one or more functional objects for access in response to an appropriate server call. In order to aid in understanding the concepts of the present invention, exemplary embodiments herein will be discussed with reference to operation of system 100 as a postage indicia generation and printing system. However, it should be appreciated that the concepts of the present invention are applicable to systems operable to provide additional or alternative functionality.

The illustrated embodiment of system 100 comprises client system 120 in communication with server system 110 via network 150. Client system 120 of embodiments is operable as a postage client and correspondingly server system 120 of embodiments is operable as a postage server. Accordingly, client system 120 and server system 110 of embodiments cooperate to generate and print postage indicia 102, such as may be utilized with respect to postal item 101.

Server system 110 may comprise one or more processor-based systems operable to provide server side operation as described herein. For example, server system 110 may comprise a computer having a processor (e.g., processors from the PENTIUM and/or XEON line of processors available from Intel Corporation), memory (e.g., random access memory (RAM), read only memory (ROM), magnetic memory, optical memory, flash memory, etc.), input/output apparatuses (e.g., display, keyboard, mouse, printer, etc.), and network interface (e.g., Ethernet interface, optical interface, T1 interface, etc.) operable under control of an instruction set defining operation as described herein.

Client system 120 may likewise comprise one or more processor-based systems operable to provide client side operation as described herein. For example, client system 120 may comprise a computer having a processor (e.g., processors from the PENTIUM and/or XEON line of processors available from Intel Corporation), memory (e.g., RAM, ROM, magnetic memory, optical memory, flash memory, etc.), input/output apparatuses (e.g., display, keyboard, mouse, printer, etc.), and network interface (e.g., Ethernet interface, optical interface, T1 interface, etc.) operable under control of an instruction set defining operation as described herein. The illustrated embodiment of client system 120 includes memory 122, operable to provide a cache memory utilized as described below, and printer 123, operable to provide printing of postage indicia 102.

Network 150 may comprise one or more networks suitable for facilitating communication between server system 110 and client system 120. For example, network 150 may comprise a local area network (LAN), metropolitan area network (MAN), wide area network (WAN), wireless network, the public switched telephone network (PSTN), the Internet, an intranet, an extranet, etc.

It should be appreciated that network 150 may include systems in addition to server system 110 and client system 120, whether utilized in providing functionality associated with server system 110 and client system 120 or separate therefrom. For example, network 150 may comprise additional servers and clients in addition to routers, gateways, bridges, repeaters, switches, caches, etc. The illustrated embodiment of system 100 shows system 130, such as may comprise a proxy server utilized by client system 120, as representative of such additional systems.

In operation according to embodiments of the invention, server system 110 functions as a web-based postage server (postage web server) providing postage indicia generation web services to clients. Accordingly, server system 110 may serve various web pages, such as may comprise platform independent hypertext mark-up language (HTML), extensible mark-up language (XML), or JAVA based web pages, to clients for performing postage indicia generation. Correspondingly, client system 120 of embodiments functions as a web-based postage client (postage web client) providing a postage indicia generation user interface to users. Accordingly, embodiments of client system 120 operate as a browser-based client, wherein platform independent code is operable within browser software executing upon client system 120. Examples of browser software as may be utilized according to embodiments of the invention include INTERNET EXPLORER available from Microsoft Corporation, FIREFOX available from Mozilla Corporation, SAFARI available from Apple Inc., and NETSCAPE NAVIGATOR available from Netscape communications Corporation.

Figure 2:
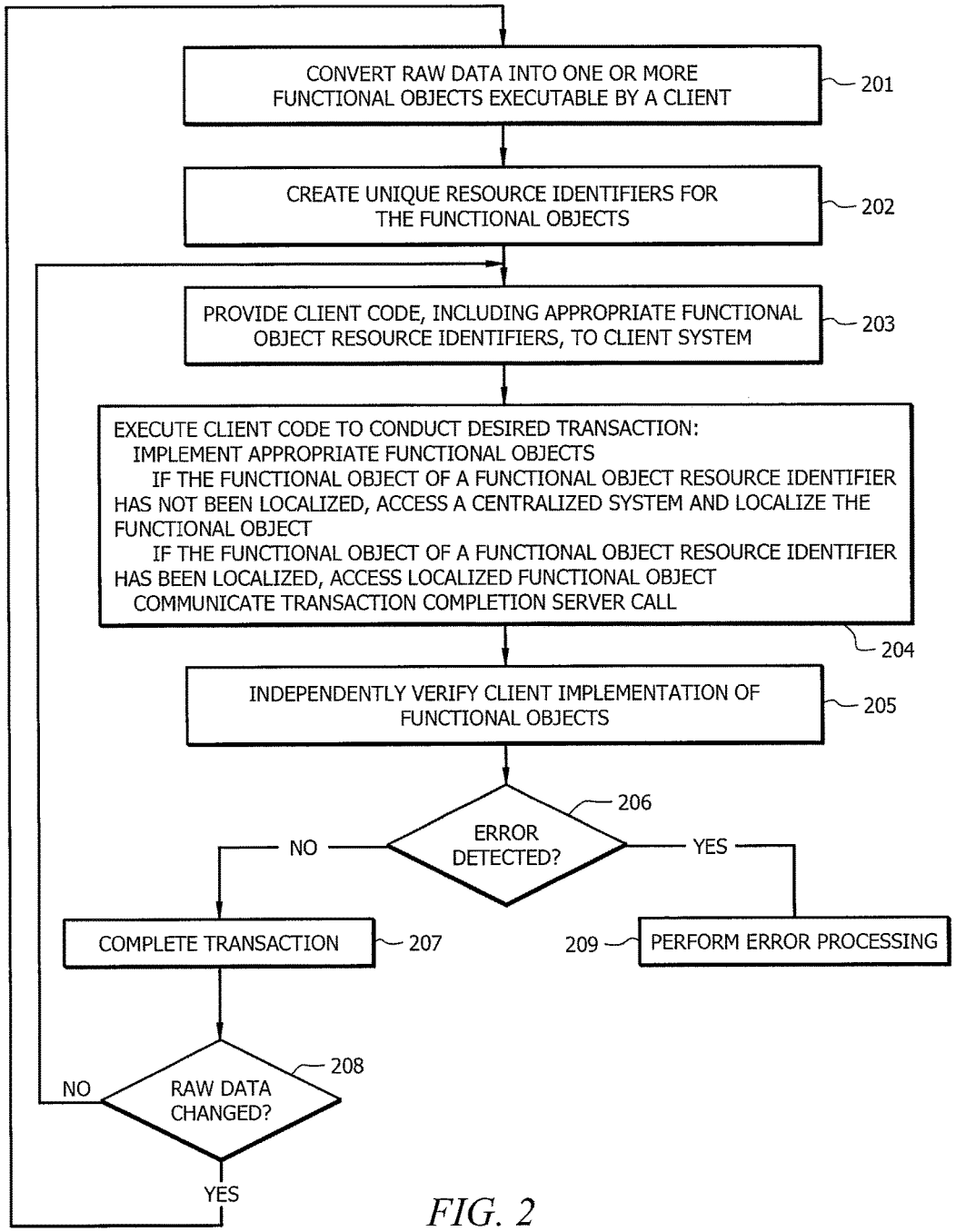
FIG. 2 shows a high level flow diagram of operation according to an embodiment of the invention.

FIG. 2 shows a high level flow diagram of operation of system 100 implementing localized functionality in a client server system using a technique of caching one or more functional objects for access in response to an appropriate server call. It should be appreciated that the particular functionality, the order of the functionality, etc. provided in FIG. 2 is intended to be exemplary of operation in accordance with the concepts of the present invention. Accordingly, the concepts herein may be implemented in various ways differing from that of the illustrated embodiment.

At block 201 of the illustrated embodiment raw data (e.g., data 103 of FIG. 1) is converted by server system 110 into one or more functional objects (e.g., functional objects 104 of FIG. 1) executable by client system 120. For example, postage rate tables, insurance rate tables, address validation databases, and/or the like may be provided to server system 110 for use in providing postage indicia generation functionality. In order to provide such data in a form to facilitate localized functionality using a caching technique, server system 110 of embodiments converts such raw data, or a portion thereof, into functional objects.

Raw data from which a functional object is created may comprise an amount of data in excess to that which can be communicated efficiently via network 150. Accordingly, embodiments of the invention operate to parse the raw data for creating useful functional objects adapted for network communication and caching as discussed herein. For example, raw data in the form of a table of postage rates throughout the nation may be parsed into smaller, useful blocks of data, such as to provide individual rate tables for each shipper zone in the nation. Such individual rate tables may thus be converted into a plurality of functional objects, each of a size conducive to communication via network 150.

Other forms of data, such as insurance rates, address databases, etc. may be similarly parsed into a plurality of functional objects. For example, an address database used for verifying recipient address information, as is required for particular services offered by the United States Postal Service (USPS), is on the order of several gigabytes. Thus, such an address database is not generally suitable for efficient communication to a client in a typical client server scenario. Embodiments of the present invention operate to parse the address database to a reduced database sufficient for verifying that the city, state, and zip code information of recipient addresses are correct (e.g., omitting additional detail with respect to the addresses), which is sufficient to satisfy the requirements of many services of the USPS. The reduced database may further be parsed into smaller collections of data, such as commercial addresses, residential addresses, geographic regions, etc. The resulting reduced address database functional objects are each preferably of a size conducive to communication via network 150.

Functional objects of embodiments of the invention comprise script files which are executable within a browser operable upon client system 120. For example, functional objects of an embodiment of the invention may comprise a JAVA script file executable by a browser of client system 120. It should be appreciated that such a script file may not only include appropriate data from the aforementioned raw data, but also includes appropriate instructions (e.g., executable code) to define operation by the host browser to perform desired functionality with respect to the data.

One or more of such functional objects may be relevant to any particular user or situation. Thus, appropriate ones of the functional objects may be provided to clients according to embodiments of the invention, as discussed below.

At block 202 of the illustrated embodiment unique or substantially unique resource identifiers are created by server system 110 for each of the functional objects. For example, unique uniform resource locators (URLs) may be assigned to each such functional object, whereby the corresponding functional object is served by server system 110 to client system 120 upon the browser of client system 120 accessing the unique URL. The resource identifiers utilized according to embodiments of the invention may include designators indicative of the type of data included in the functional objects, the valid date or dates for the data included in the functional objects, or other attributes regarding the use or contents of the functional objects. Alternatively, the resource identifiers utilized according to embodiments of the invention may be arbitrary with respect to the functional objects.

As previously mentioned, and as will be better appreciated from the discussion which follows, the resource identifiers provide unique or substantially unique identification of an associated functional object. By substantially unique, it is meant that within the typical operation of system 100 a resource identifier is unique. Although resource identifiers may ultimately be repeated, and thus not truly unique, such repetition is provided such that disambiguation between two or more functional objects is not required. The foregoing unique identification not only facilitates operation of appropriate functionality through access of a functional object using its resource identification, but also facilitates updating, replacement, revision, etc. of the functional objects without express user interaction or even knowledge of the updating and without actively flushing out of date functional objects from cache, all within the normal operational framework of host browser software.

At block 203 of the illustrated embodiment client code for performing postage indicia generation operation is provided by server system 110 to client system 120. For example, a user of client system 120 may launch browser software thereon and navigate to a web page served by server system 110 for postage indicia generation services. This may result in code, such as in the form of a web page, applets, etc., being provided by server system 110 to client system 120. The foregoing code preferably includes resource identifiers (e.g., URLs) for appropriate functional objects useful to the user's generation of postage indicia for implementing one or more functional objects as desired for postage indicia generation.

At block 204 of the illustrated embodiment, client system 120 executes the code within a host browser thereof to provide postage indicia generation operation in cooperation with server system 110. Details with respect to client server operation to provide postage indicia generation and printing is provided in aforementioned patent application entitled "Virtual Security Device."

Execution of postage indicia generation code provided to client system 120 of embodiments of the invention operates to implement one or more of the foregoing functional objects, as appropriate. Moreover, such execution implements localized functionality, within the normal operational framework of host browser software, using a technique of caching one or more such functional objects for access in response to an appropriate server call.

In operation according to embodiments of the invention, where execution of the postage indicia generation code by client system 120 is to implement functionality provided by a particular functional object, the resource identifier for a current instance of the functional object is present in the code. The browser of client system 120 then accesses the functional object using the resource identifier. If the current instance of the functional object, as indicated by its unique or substantially unique resource identifier, has not been previously accessed by client system 120, the resource identifier will direct the browser to server system 110, or other resource server, to provide the functional object to client system 120. Operation of the host browser of client system 120, perhaps in accordance with instructions of the postage indicia generation code, causes the current instance of the functional object to be cached, such as within memory 122 by a browser cache of client system 120. Accordingly, if the current instance of the functional object has been previously accessed by client system 120, the functional object will be accessed from cache (e.g., from memory 122) when the resource identifier directs the browser to server system 110, or other resource server.

The foregoing operation facilitates providing only those functional objects actually utilized by a client system to that client system. Accordingly, where a client system only utilizes a limited amount of data, such as associated with a single shipping zone, only the functional object containing that data need be provided to the client system. If the client system should subsequently need additional data, such as associated with another shipping zone, the functional object containing that data may be provided to the client system when needed. Each such functional object is preferably cached for subsequent use by the client system. However, embodiments of the invention may operate to cache only particular functional objects, such as those expected to receive repeated use, those historically receiving repeated use, etc.

It should be appreciated that caching of functional objects according to embodiments of the present invention differs significantly from mere automatic caching of data. For example, embodiments of the invention operate to cache a parsed subset of data and code for its use as an object for future performing functions in the future (e.g., future calculations). Automated caching merely caches the information provided to the client. Where postage rating functionality is performed, such caching would result in only the particular rate determination for a mail piece being cached (which is generally not useful with respect to future mail pieces). A server would not generally provide a postage rate table to the client in prior client server models due to the size of the rate table being too large to efficiently communicate and too large for caching/storage by the client. Moreover, the foregoing unique or substantially unique resource identifiers facilitates updating, replacement, revision, etc. of the functional objects without express user interaction or even knowledge of the updating and without actively flushing out of date functional objects from cache, all within the normal operational framework of host browser software. That is, as the data of a functional object becomes out of date, and thus an updated functional object is created, an updated unique resource identifier is used to direct the client to the updated functional object rather than using a cached instance of the functional object.

As previously mentioned, the functional objects of embodiments of the invention comprise script files which are executable within the browser operable upon client system 120. Such script files according to embodiments includes appropriate instructions (e.g., executable code) and data to define operation by the host browser to perform desired functionality. For example, the postage indicia generation code may operate to solicit information regarding a mail piece, a destination address, the class of service desired, etc. and invoke a functional object providing postage rating functionality. Thus the functional object may be executed by client system 120 to determine a postage rate appropriate to the postal item. Where the user has previously invoked this postage rating functionality, communication with server system 110 may be avoided and client system 120 may autonomously operate to provide the rating functionality. Should the user wish to view various postage rating options, multiple instances of server calls may likewise be avoided.

A plurality of functional objects may be invoked, one or more of which may itself be invoked a plurality of times, throughout execution of the postage indicia generation code. Continuing with the above example, after operation to provide postal item rating using a first functional object, an embodiment of the present invention may invoke a second functional object, such as to calculate an insurance rate for the postal item appropriate to the postal service selected, verify recipient address information (e.g., ensure the city, state, and zip code for the intended recipient are correct and up to date), etc.

After operation of the postage indicia generation code and appropriate functional objects, the illustrated embodiment of block 204 operates to make a transaction completion server call from client system 120 to server system 110. For example, having collected postal item information, determined a postal rate for the selected postal service, and verified the city, state, and zip code of a recipient address is accurate, client system 120 may provide the appropriate information to server system 110 to request generation of a postage indicium, preferably associated with debiting a postal security device (e.g., postage vault) by an amount suitable for the postage indicium and/or the postage indicia generation service.

At block 205 of the illustrated embodiment, server system 110 operates to independently verify proper implementation of the functional objects. Functional objects provided for use by clients may be subject to malicious or inadvertent alteration, or otherwise be improperly used. Accordingly, server system 110 of the illustrated embodiment implements verification of the results of use of the use of functional objects by client system 120 prior to completing a transaction (e.g., prior to generating a requested postage indicium). For example, server system 110 may operate to independently verify the rate calculation for a postage indicium requested to be generated by client system 120 having implemented a postage rating script. Such verification may be accomplished using mail piece data provided by client system 120 and rating table information available at server system 110. Such verification not only prevents instances of functional object tampering or alternation, but may also be used to ensure that the most up to date information has been used with respect to the related functions.

At block 206 of the illustrated embodiment a determination is made as to whether the foregoing verification has detected an error. If an error is detected, processing according to the illustrated embodiment proceeds to block 209 for performing error processing. For example, client system 120 may be prevented from further postage indicia generation operation until a source of the error can be determined. Alternatively, a functional object associated with the detected error may be pushed to client system 120 and postage indicia generation operation repeated in an attempt to correct the error.

If, however, no error is detected at block 206, processing according to the illustrated embodiment proceeds to block 207 for completion of the transaction. For example, server system 110 may generate the requested postage indicium, preferably debiting a postal security device (e.g., postage vault) associated with the user, and providing a data packet comprising the generated postage indicium to client system 120. Client system 120 may utilize the data packet comprising the generated postage indicium to print postage indicium 102 on mail piece 101 using printer 123.

Upon completion of the transaction at block 207, processing according to the illustrated embodiment proceeds to block 208 wherein a determination is made as to whether any of the raw data of the functional objects has changed (e.g., data has been updated, has expired, etc.). If the raw data has not changed, processing according to the illustrated embodiment returns to block 203 to facilitate performing repeated transactions using the current instance of the functional objects. However, if the raw data, or a portion thereof, has changed, processing according to the illustrated embodiment returns to block 201 to facilitate conversion of the changed raw data to a revised (then to be current) instance of a functional object. As previously mentioned, the use of resource identifiers according to embodiments facilitates operation of the clients to use up to date functional objects provided by such processing.

It should be appreciated that operation according to the embodiment of FIG. 2 provides localized functionality in system 100 using a technique of caching one or more functional objects for access in response to an appropriate server call. Accordingly, latency associated with communication to and from server system 110 is avoided when performing particular functions. The latency avoided in a typical postage indicia generation scenario may be in the range of 2-3 seconds for each function call. Accordingly, where a function is repeated (e.g., when comparing rate options) and where multiple functions are performed (e.g., postage rating, insurance rating, address verification, etc.) appreciable amounts of time may be saved with respect to completing an individual transaction. Where multiple transactions are performed (e.g., generating postage indicia for a batch of mail items), aggregated amounts of time become quite substantial. Moreover, not only is latency associated with communication reduced according to embodiments of the invention, but processing load is reduced at server system 110 thereby facilitating a reduction in latency associated with processing delays.

It should be appreciated that, although embodiments have been discussed herein with reference to providing functional objects to clients by server 110, embodiments of the invention may implement various techniques for distributing functional objects to clients. For example, a copy and distribute network may be implemented wherein various servers which are geographically dispersed are provided with functional objects. Resource identifiers utilized according to embodiments of the invention may operate to obtain a functional object from a particular server disposed geographically most near a client system, thereby further optimizing network communications utilized in the client server processing.

Although embodiments have been discussed with respect to caching functional objects in a memory of the client system, the localized functionality provided herein need not be cached in such a memory to achieve benefits as discussed herein. For example, functional objects may be cached by server 130, such as may comprise a proxy server, disposed more near client system 120 (e.g., on a same LAN, geographically more near, etc.) than is server system 110 and latency may be reduced as discussed above.

It should be appreciated that the concepts herein are not limited in applicability to the exemplary postage indicia generation processing. For example, embodiments of the present invention may be implemented with respect to client server services implementing amortization tables, tax rate tables, regulations, etc. Similarly, the concepts herein are not limited in applicability to the exemplary postal items. For example, embodiments of the present invention may be implemented with respect to items transported by services such as Federal Express, United Parcel Service, trucking services, rail services, air carrier services, etc.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

identifying, at a postage generation server computing system, a subset of raw postage rating data, wherein said subset of raw postage rating data is identified as useful to a remote computing system for performing a postage indicium generation function associated with creating at least one postage indicium request;

converting, at said postage generation server computing system, said subset of said raw postage rating data into one or more postage rating script functional objects that are executable by said remote computing system when performing said postage indicium generation function associated with creating said at least one postage indicium request;

sending at least one postage rating script functional object of said one or more postage rating script functional objects to said remote computing system to be cached, wherein said remote computing system is located remote to said postage generation server computing system and communicates with said postage generation server computing system via a network;

receiving, at said postage generation server computing system, a postage indicium request, wherein said postage indicium request was created by the postage indicium generation function of the remote computing system using said cached at least one postage rating script functional object by making a call to said cached at least one postage rating script functional object;

using, by said postage generation server computing system, at least a portion of said postage indicium request to determine that said cached at least one postage rating script functional object produced an erroneous postage indicium request, wherein determining that said cached at least one postage rating script functional object produced the erroneous postage indicium request comprises the postage generation server computing system independently performing a function of the at least one postage rating script functional object to verify results of use of the at least one postage rating script functional object by the postage indicium generation function of the remote computing system; and based at least on the determination that said at least one postage rating script functional object produced the erroneous postage indicium request, sending an updated at least one postage rating script functional object to said remote computing system to be cached.

2. The method of claim 1 further comprising:

creating a substantially unique resource identifier for each of said one or more postage rating script functional objects, thereby creating one or more substantially unique resource identifiers, wherein when creating said postage indicium request, code is executed by the postage indicium generation function that uses said substantially unique resource identifier to call said cached at least one postage rating script functional object.

3. The method of claim 2, wherein said one or more substantially unique resource identifiers each comprise a substantially unique uniform resource locator (URL).

4. The method of claim 1, wherein said updated at least one postage rating script functional object includes updated raw postage rating data for a particular locale, said updated raw postage rating data still being useful for creating at least one postage indicium request.

5. The method of claim 1, wherein using said cached at least one postage rating script functional object in creating the postage indicium request comprises rating a postal item for a postage indicium to be created in association with the postage indicium request.

6. The method of claim 1, wherein said raw postage rating data comprises postal insurance information and using said cached at least one postage rating script functional object in creating the postage indicium request comprises postal insurance rating for a postal item associated with the postage indicium request.

7. The method of claim 1, wherein said converting said subset of said raw postage rating data into one or more postage rating script functional objects comprises:

parsing said raw postage rating data to provide said one or more postage rating script functional objects in a size optimized for client-server network communication.

8. The method of claim 1, wherein said one or more postage rating script functional objects comprise platform independent scripts executable within a browser of a client computing system.

9. The method of claim 1, wherein said method is operable on a plurality of postage indicia requests for a batch of items, said method further comprising:

receiving a plurality of additional postage indicium requests after said receiving said postage indicium request, wherein said plurality of additional postage indicium requests were created using said cached updated at least one postage rating script functional object, and wherein said plurality of additional postage indicium requests are part of a same batch; and based at least on a determination that said cached updated at least one postage rating script functional object produced a first postage indicium request of the plurality of additional postage indicium requests with no error, processing remaining postage indicium requests of said plurality of additional postage indicium requests without determining that said remaining postage indicium requests were produced from said cached updated at least one postage rating script functional object with no error.

10. A postage indicia distribution system comprising:

a client computing system having cache memory associated therewith, said client computing system configured under control of browser software executing platform independent postage indicia generation code for performing a postage indicia generation function, wherein said client computing system is located remote to a postage server computing system and communicates with said postage server computing system via a network; and a first browser executable postage rating script, which was created for said client computing system by said postage server computing system, stored in said cache memory and identified by a first substantially unique uniform resource locator, wherein execution of said platform independent postage indicia generation code invokes said first browser executable postage rating script from said cache memory to create a postage indicium generation request associated with postage indicium generation using said first substantially unique uniform resource locator, wherein said created postage indicium generation request is sent to said postage server computing system and requests authorization of said postage indicium generation;

wherein said client computing system is configured to receive a request response, wherein said request response is received in response to said postage server computing system determining that said invoked first browser executable postage rating script produced an erroneous postage indicium generation request in which a rate calculation of the postage indicium generation request is determined to be incorrect by the postage server computing system independently performing a function of the first browser executable postage rating script, and wherein said request response comprises a second browser executable postage rating script having updated postage data regarding a postage indicia generation function of the first and second browser executable postage rating scripts contained therein, which is stored in said cache memory.

11. The postage indicia distribution system of claim 10 wherein said second browser executable postage rating script is identified by a second substantially unique uniform resource locator, wherein execution of said platform independent postage indicia generation code invokes said second browser executable postage rating script rather than invoking said first browser executable postage rating script, and wherein said first browser executable postage rating script is considered as having inaccurate postage data regarding said postage indicia generation function contained therein upon said client computing system receiving said request response, and wherein said request response denies authorization of said postage indicium generation based on said invoked first browser executable postage rating script being inaccurate.

12. The postage indicia distribution system of claim 11, wherein said client computing system receives updates to said platform independent postage indicia generation code for performing postage indicia generation to include said second uniform resource locator.

13. The postage indicia distribution system of claim 10, wherein said cache memory is internal to said client computing system.

14. The postage indicia distribution system of claim 10, wherein said cache memory is remote from said client computing system and in Internet communication with said client computing system.

15. A method comprising:

receiving one or more postage rating script functional objects from a postage generation server computing system at a client computing system, wherein said one or more postage rating script functional objects were created by said postage generation server computing system using a subset of raw postage rating data that has been identified by said postage generation server computing system as useful for performing a postage indicium generation function associated with creating at least one postage indicium request at said client computing system, and wherein said client computing system is located remote to said postage generation server computing system and communicates with said postage generation server computing system via a network;

caching, in a cache of said client computing system, at least one of said one or more postage rating script functional objects;

generating, by said client computing system, a postage indicium request, wherein said postage indicium request is generated by the postage indicium generation function using said cached at least one postage rating script functional object by making a call to the cached at least one postage rating script functional object;

sending, by said client computing system, said postage indicium request to said postage generation server computing system; and receiving, by said client computing system, a postage indicium request response comprising an updated at least one postage rating script functional object, wherein said postage indicium request response is received in response to verification that said at least one postage rating script functional object produced an erroneous postage indicium request, wherein the verification that the cached at least one postage rating script functional object produced the erroneous postage indicium request comprises the postage generation server computing system independently performing a function of the at least one postage rating script functional object to verify results of use of the at least one postage rating script functional object by the postage indicium generation function of the client computing system.

16. The method of claim 15 further comprising:

creating a substantially unique resource identifier for each of said one or more postage rating script functional objects, thereby creating one or more substantially unique resource identifiers, wherein when creating said postage indicium request, code is executed by the postage indicium generation function that uses said substantially unique resource identifier to call said cached at least one postage rating script functional object.

17. The method of claim 16, wherein said one or more substantially unique resource identifiers each comprise a substantially unique uniform resource locator (URL).

18. The method of claim 15, wherein using said cached at least one postage rating script functional object in creating the postage indicium request comprises rating a postal item for a postage indicium to be created in association with the postage indicium request.

19. The method of claim 15, wherein said raw postage rating data comprises postal insurance information and using said cached at least one postage rating script functional object in creating the postage indicium request comprises postal insurance rating for a postal item associated with the postage indicium request.

20. The method of claim 15, wherein said using said subset of raw postage rating data to create said one or more postage rating script functional objects comprises:

parsing said raw postage rating data to provide said one or more postage rating script functional objects in a size optimized for client-server network communication.

21. The method of claim 15, wherein said one or more postage rating script functional objects comprise platform independent scripts executable within a browser of the client computing system.

22. A postage indicia distribution system comprising:

a server computing system comprising:

a processor; and a memory, communicatively coupled to the processor; wherein the server computing system is configured to perform steps comprising:

identifying a subset of raw postage rate table data, wherein said subset of raw postage rate table data is identified as relevant to performing a postage indicium generation function associated with creating at least one postage indicium generation request using a cache memory;

converting said subset of raw postage rate table data into one or more postage rating script functional objects, said raw postage rate table data being useful for performing a postage rating function associated with the postage indicium generation request using said cache memory, wherein said cache memory is located remote to said server computing system, and wherein said server computing system sends said one or more postage rating script functional objects to said cache memory for storage via a network;

receiving a postage indicium generation request, wherein said postage indicium generation request was created by the postage indicium generation function using postage rating information provided by said cached one or more postage rating script functional objects by making a call to the cached one or more postage rating script functional objects; and creating a postage indicium generation request response in response to said received postage indicium generation request, wherein said postage indicium generation request response comprises an updated one or more postage rating script functional objects to store on said cache memory, wherein said postage indicium generation request response is created in response to said server computing system determining that said cached one or more postage rating script functional objects used to create said postage indicium generation request produced an erroneous postage indicium generation request, and wherein determining that the cached one or more postage rating script functional objects produced the erroneous postage indicium generation request comprises the server computing system independently performing a function of the one or more postage rating script functional objects to verify results of use of the one or more postage rating script functional objects by the postage indicium generation function.

23. The postage indicia distribution system of claim 22, wherein said one or more postage rating script functional objects is associated with a respective substantially unique resource identifier, wherein when creating said postage indicium generation request, code is executed that uses said respective substantially unique resource identifier to access said cached one or more postage rating script functional objects.

24. The postage indicia distribution system of claim 22, wherein said server computing system converts at least a portion of updated raw postage rate table data for a particular locale into said updated one or more postage rating script functional objects, said updated raw postage rate table data being useful for performing the postage rating function associated with postage indicia generation.

25. The postage indicia distribution system of claim 22, wherein when said server computing system converts said raw postage rate table data into the one or more postage rating script functional objects, said server computing system parses said raw postage rate table data to provide said one or more postage rating script functional objects in a size optimized for client-server network communication.

* * * * *